United States Patent [19]

Groen

[11] 4,231,737

[45] Nov. 4, 1980

[54] APPARATUS FOR REMOVABLY SUPPORTING AT LEAST ONE MEDICAL, PARTICULARLY DENTAL INSTRUMENT, SUCH AS A DENTAL DRILL OR THE LIKE

[75] Inventor: Johannes Groen, Loenen, Netherlands

[73] Assignee: Holland Dental B.V., Baarn, Netherlands

[21] Appl. No.: 945,698

[22] Filed: Sep. 14, 1978

[30] Foreign Application Priority Data

Sep. 19, 1977 [NL] Netherlands ..... 7710232

[51] Int. Cl.[3] ..... A61G 1/14

[52] U.S. Cl. ..... 433/78

[58] Field of Search ..... 242/47.5, 355.23, 355.24, 242/355.26; 433/78, 28

[56] References Cited

U.S. PATENT DOCUMENTS

| | | | |
|---|---|---|---|
| 3,672,059 | 6/1972 | Booth | 32/22 |
| 3,722,095 | 3/1973 | Pietschmann | 32/22 |

*Primary Examiner*—Robert Peshock

*Attorney, Agent, or Firm*—Kane, Dalsimer, Kane, Sullivan and Kurucz

[57] ABSTRACT

An apparatus for removably supporting a medical or dental instrument is provided, which instrument is connected by a flexible supply tube to a connection means. The apparatus comprises a box provided with a holder for the instrument and accommodating the tube connection means. The box further contains a device for automatically retracting the tube at least partly into the box when the instrument is placed into the holder and for automatically releasing the tube from the box as soon as the instrument is taken from its holder.

7 Claims, 2 Drawing Figures

APPARATUS FOR REMOVABLY SUPPORTING AT LEAST ONE MEDICAL, PARTICULARLY DENTAL INSTRUMENT, SUCH AS A DENTAL DRILL OR THE LIKE

BACKGROUND OF THE INVENTION

The invention relates to an apparatus for removably supporting at least one medical, particularly dental instrument, such as a dental drill or the like, of the type having one end of an elongate flexible supply tube connected hereto. Such apparatus generally comprises a box having an instrument panel, a holder for the instrument on the panel, connection means in the box for the other end of the flexible supply tube, and means for retracting the tube at least partially into the box when the instrument is placed in the holder while allowing the tube to be released from its retracted position when the instrument is taken from the holder. The supply tube may serve for feeding a pressure fluid to the instrument, such as cooling water and/or compressed air for driving a turbine-driven drill of the instrument, while the tube may also comprise electric leads.

In conventional apparatuses of the above-mentioned type the supply tube in its retracted position is wound on a spring-mounted reel or the like inside the box. If one wants to use the instrument, a pulling force must be exerted on the tube to unwind the same from the reel against the action of the spring, locking means being provided cooperating with the reel to prevent the tube from being pulled back into the box by this spring. In order to obtain a sufficient tube length released from the box for the unimpeded handling of the instrument, the user, such as a dentist, must always pull a little more length of tube out of the box than would be strictly necessary for reaching the patient. For disengaging the locking means acting on the reel to allow the tube to be again retracted into the box, a similar short pull must be exerted on the tube. These pulling movements which the dentist must repeatedly carry out can be very tiring in the long run.

SUMMARY OF THE INVENTION

It is an object of the invention to provide an apparatus of the above-described kind which obviates this disadvantage and which allows the tube to be released from the box and to be retracted again into the box without the necessity of exerting any pulling force on the tube. It is another object of the invention to provide such an apparatus in which the tube is automatically released from the box when the instrument is taken from its holder and in which the tube is again automatically retracted into the box when the instrument is placed in its holder.

The tube retracting and releasing means of the apparatus according to the invention generally comprises a tube-engaging member movably mounted in the box between a position retracting the tube and a position substantially completely releasing the tube from the box, respectively, which tube-engaging member can be moved by reversible drive means between said two end positions. Control means for the drive means are provided which control means actuate the drive means to retract the tube when the instrument is placed in the holder and which control means actuate the drive means to release the tube when the instrument is removed from the holder. These control means are preferably mounted on the holder for actuation by the instrument when the same is placed in or removed from the holder. The control means may, for instance, comprise a micro-switch.

In a preferred embodiment of the invention, the tube-engaging member comprises a slide member and guide means in the box for this slide member allowing reciprocal movement of this member towards and away from the holder, the slide member carrying a guide roller and the tube passing from the tube connection means around this guide roller to the instrument. Thus, when the instrument is situated in the holder, the slide member is in one end position away from the holder, thereby keeping the tube straightened and preferably under a slight tension at least partly inside the box. When the instrument is taken from the holder, the drive means quickly move the slide member to its other end position adjacent the holder whereby the tube is released and fed out of the box to hang down therefrom in a free loop.

BRIEF DESCRIPTION OF THE DRAWINGS

The foregoing and other objects and features of the invention will be more fully understood from a reading of the following description in conjunction with the drawings, in which.

DESCRIPTION OF THE PREFERRED EMBODIMENT

Figure 1:
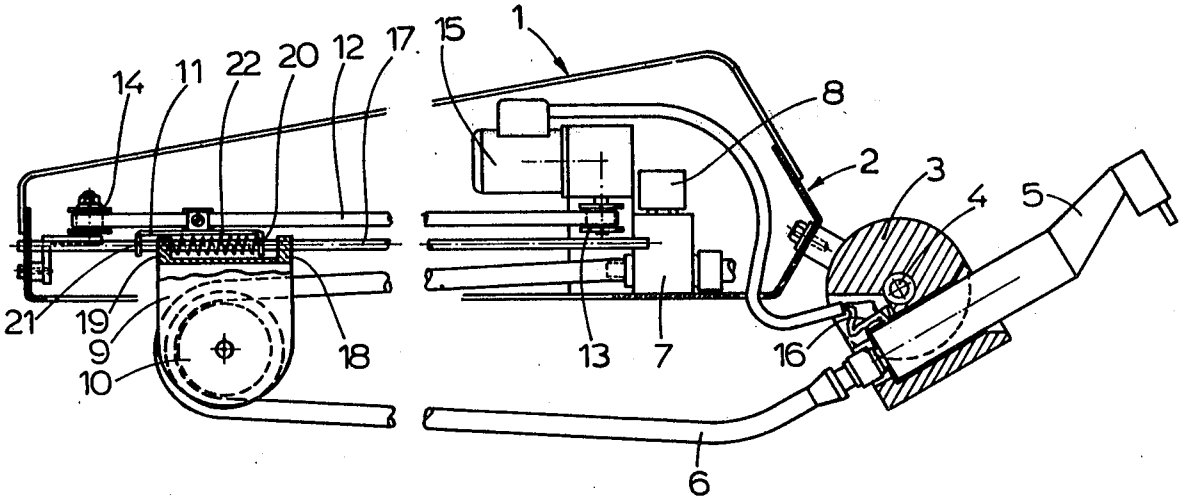
FIG. 1 is a side elevation and partly a cross-section of a preferred embodiment of the apparatus of the invention, the instrument being shown in its rest position in the holder.

The drawings show a box 1 for holding one or more dental instruments, such as a dental drill 5, but it should be understood that the invention is not limited to such use and could also be employed for removably supporting one or more other, particularly medical instruments.

As shown, the box 1 comprises a closed upper wall, a front panel 2 and a slotted bottom wall. An instrument holder 3 is mounted by suitable means on the front panel 2 so as to be adjustable about a supporting shaft 4 to allow the holder and the instrument supported therein to be placed in the desired angular position for easy availability. The holder 3 may be made of a suitable plastic material and is of conventional design having a recess or seat adapted to receive the instrument 5 in a position in which a supply tube 6 connected to this instrument extends rearwardly therefrom. The seat of the holder has the usual longitudinal slot (not visible in the drawings) of a width somewhat greater than the diameter of the tube 6 so that the instrument 5 may be removed from the holder by pulling the same lengthwise from its seat whereupon the tube can pass through this slot. The other end of the supply tube 6 is secured to a tube connection means 7 mounted inside the box 1 and connected to, for instance, a source of pressurized air and/or water (not shown).

As shown, the instrument 6 can be a dental drill driven for instance by an air-turbine and also fed with cooling water and/or air. In this case the supply tube 6 generally comprises three conduits. However, the instrument may also comprise a small electric motor in which case the tube 6 would also contain suitable electric leads for this motor. The supply of water and/or air for cooling can be adjusted by means of magnetic valves 8.

Figure 2:
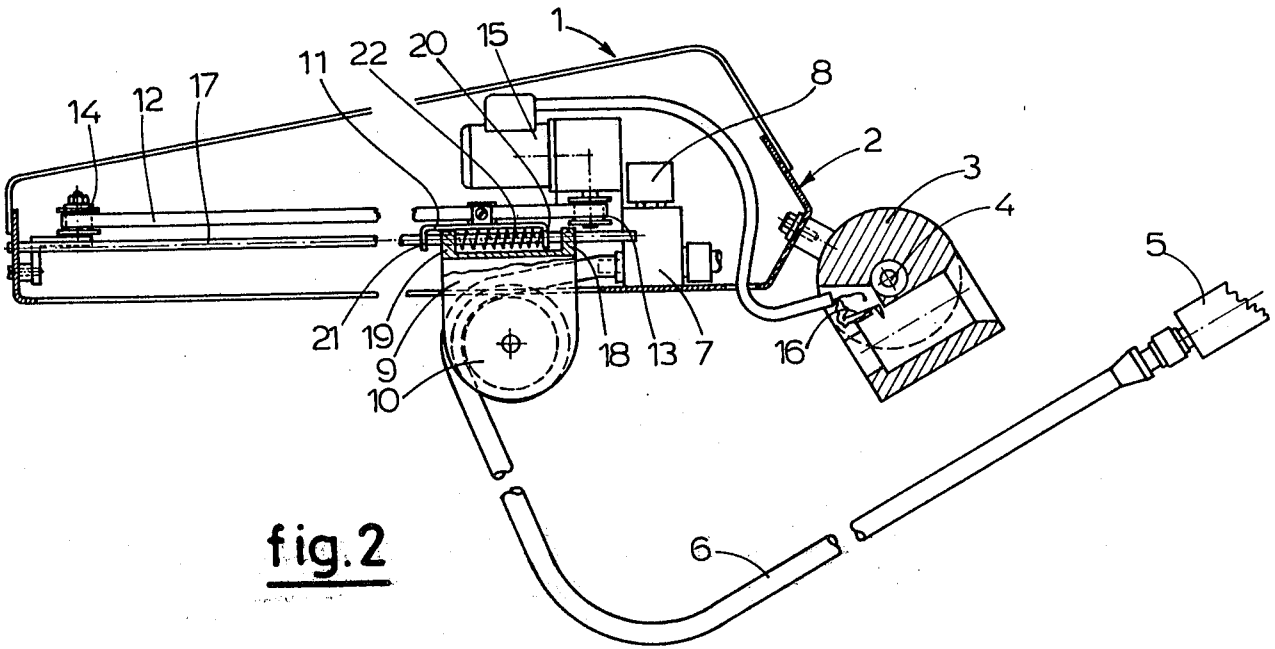
FIG. 2 is a similar view as FIG. 1 in which the instrument has been removed from the holder and the supply tube depends freely from the box.

The box 1 contains a device for retracting the flexible tube 6 when the instrument 5 is placed in the holder 3 (FIG. 1) and for releasing this tube 6 from the box when the instrument is taken from the holder (FIG. 2). This device comprises a guide rod 17 fixedly mounted inside the box 1 in a horizontal position and a slide member slidable on this guide rod 17 between two end positions. In the one end position the slide member is farthest removed from the holder 3 and the connection means 7 (FIG. 1) and in the other end position the slide member is situated adjacent the connection means 7 (FIG. 2). The slide member consists of two separate parts, a carrier member 9 and a drive bracket 11. The carrier member 9 has two upwardly projecting ears 18 and 19 through which the guide rod 17 extends. A guide roller 10 for the supply tube 6 is mounted for free rotation in the carrier member 9, the tube 6 passing around this guide roller on its way from the connection means 7 to the instrument 5. The drive bracket 11 likewise has two depending ears 20 and 21 through which the guide rod 17 extends and which are offset with respect to the ears 18 and 19 of the carrier member 9. A coil spring 22 is arranged about the guide rod 17 between the ears 19 and 20, thereby urging the carrier member 9 to the left, as seen in the drawings, with respect to the bracket 11 to a position in which its ears 18 and 19 would abut the bracket ears 20 and 21, respectively.

The drive means for the slide member comprise an endless toothed belt 12 which passes around and engages two toothed end pulleys or pinions 13 and 14, the pinion 13 being coupled to a reversible electric motor 15 for driving the belt 12. The belt 12 has a part extending parallel to and above the guide rod 17 and, as shown, the bracket 11 is secured to this part of the belt. The operation of the electric motor 15 is controlled by a control circuit comprising control means 16 arranged in the holder 3 for actuation by the instrument 5 when the latter is placed in the holder or removed therefrom. In the embodiment shown, this control means 16 is a microswitch with a switch arm projecting into the recess of the holder to be engaged by the instrument. However, control means of other types may be used. When the instrument 5 is removed from its rest position of FIG. 1 in the holder 3, the microswitch 16 is actuated to energize the electric motor 15 for operation in a direction in which the belt 12 drives the bracket 11 and thereby the carrier member 9 from its left-hand end position to the right until the motor is stopped when the bracket 11 reaches its right-hand end position of FIG. 2. When the instrument 5 is again placed in the holder 3, the microswitch is actuated to energize the electric motor 8 for operation in the opposite sense in which case the belt 17 moves the bracket 11 to the left until the motor is stopped when the bracket 11 reaches its left-hand end position of FIG. 1. For stopping the motor 15 at the end of the forward or return movement of the bracket 11, suitable limit switches may be used (not shown) such as reed-switches in which case the bracket 11 would be provided with a small permanent magnet for the actuation of these switches in the two end positions of the bracket. However, in the present embodiment the motor 15 is an electric step motor which is stopped after rotation through a predetermined number of steps corresponding to the track length of the bracket 11. Control circuits for controlling the operation of a reversible electric motor in the above described manner are as such well known in the art and are therefore not further described in detail. The flexible tube 6 has such a length that in its retracted rest position of FIG. 1 it is held under slight tension by the spring 22 and extends in a horizontal loop from the connection means 7 around the guide roller 10 to the instrument 5 in the holder 3. The resilient coupling between the drive bracket 11 and the carrier member 9 by means of the spring 22 makes it possible to accommodate small variations in length of the tube 6. The spring 22 also allows a further tensioning of the flexible tube 6 and a corresponding small movement of the carrier member 9 to the right with respect to the stationary bracket 11 in the position of FIG. 1 when the instrument 5 is pulled out of its seat in the holder 3 until the micro-switch 16 becomes disengaged from the instrument and thereby starts the electric motor 15. The motor 15 then quickly moves the bracket 11 and carrier member 9 with the guide roller 10 to the position of FIG. 2 whereby the tube 6 is quickly released from the box 1 through the slot in the bottom thereof for unimpeded use of the instrument 5. Upon replacement of the instrument in the holder 3 the tube 6 is again quickly retracted to the position of FIG. 1 to prevent the tube 6 from hanging down loopwise from the box 1 in an uncontrolled manner.

While the invention has been shown and described with reference to a specific embodiment thereof it will be understood that other embodiments may be resorted to without departing from the invention.

What is claimed is:

1. An apparatus for removably supporting at least one medical, particularly dental instrument, such as a dental drill or the like, of the type having one end of an elongate flexible supply tube connected thereto, said apparatus including a box having an instrument panel, a holder for the instrument on said panel, connection means in said box for connecting the other end of said flexible supply tube, and tube retracting and releasing means comprising a tube-engaging member movably mounted in said box between a first end position retracting said tube at least partially into said box and a second end position substantially completely releasing said tube from said box, respectively, reversible drive means for said tube-engaging member to move said member between said two end positions, and control means for said drive means, said control means actuating said drive means to retract said tube when said instrument is placed in said holder and actuating said drive means to release said tube from said box when said instrument is removed from said holder, respectively.

2. The apparatus of claim 1, wherein said tube engaging member comprises a slide member, guide means being provided in the box for said slide member allowing reciprocal movement of said member towards and away from said holder, said slide member carrying a tube guide roller and said tube passing from said tube connection means around said guide roller to said instrument.

3. An apparatus for removably supporting at least one medical, particularly dental instrument, such as a dental drill or the like, of the type having one end of an elongate flexible supply tube connected thereto, said apparatus including: a box having an instrument panel; a holder for the instrument on said panel; connection means in said box for connecting the other end of said flexible supply tube; tube retracting and releasing means comprising a tube-engaging member movably mounted in said box between a first end position retracting said tube at least partially into said box and a second end position substantially completely releasing said tube from said box, respectively; reversible drive means for said tube-engaging member to move said member between said two end positions; said tube-engaging member comprises a slide member, guide means being provided in the box for said slide member allowing reciprocal movement of said member towards and away from said holder, said slide member carrying a tube guide roller and said tube passing from said tube connection means around said guide roller to said instrument; said drive means comprises an endless belt having a part extending parallel to said guide means, said slide member being connected to said belt, a reversible motor coupled to said belt; and control means for said drive means, said control means actuating said drive means to retract said tube when said instrument is placed in said holder and actuating said drive means to release said tube when said instrument is removed from said holder, respectively.

4. The apparatus of claim 1, wherein said control means is mounted in said holder for actuation by said instrument when the latter is placed in or removed from said holder.

5. The apparatus of claim 4, wherein said control means comprises a micro-switch.

6. An apparatus for removably supporting at least one medical, particularly dental instrument, such as a dental drill or the like, of the type having one end of an elongate flexible supply tube connected thereto, said apparatus including: a box having an instrument panel; a holder for the instrument on said panel; connection means in said box for connecting the other end of said flexible supply tube; tube retracting and releasing means comprising a tube-engaging member movably mounted in said box between a first end position retracting said tube at least partially into said box and a second end position substantially completely releasing said tube from said box, respectively; reversible drive means for said tube-engaging member to move said member between said two end positions; said tube engaging member comprises a slide member, guide means being provided in the box for said slide member allowing reciprocal movement of said member towards and away from said holder, said slide member carrying a tube guide roller and said tube passing from said tube connection means around said guide roller to said instrument; said slide member comprises a first part connected to said drive means and a second part carrying said guide roller, means for slidably connecting said two slide member parts to each other for limited relative sliding movement parallel to said guide means, a spring acting between said two slide member parts urging said second part with respect to the first part in a direction away from the holder; and control means for said drive means, said control means actuating said drive means to retract said tube when said instrument is placed in said holder and actuating said drive means to release said tube when said instrument is removed from said holder, respectively.

7. The apparatus of claim 3, wherein said belt is a toothed belt, said motor driving a pinion, operatively engaging said toothed belt.

* * * * *